US008426347B2

(12) United States Patent
Hughes et al.

(10) Patent No.: US 8,426,347 B2
(45) Date of Patent: Apr. 23, 2013

(54) PROCESS FOR PREPARING HIGH CONCENTRATIONS OF MAGNESIUM AND BORON COMBINATION MATERIALS

(75) Inventors: Mark D. Hughes, Montgomery, TX (US); Leslie J. Flinn, Trinity, TX (US); Daniel T. Smith, Montgomery, TX (US); Nathaniel J. Smoter, Cypress, TX (US); Theo Eliades, Toronto (CA); Kenneth W. Koch, Sr., Manchester, MO (US)

(73) Assignee: Envirochem Solutions LLC, Montgomery, TX (US)

( * ) Notice: Subject to any disclaimer, the term of this patent is extended or adjusted under 35 U.S.C. 154(b) by 628 days.

(21) Appl. No.: 12/626,887

(22) Filed: Nov. 28, 2009

(65) Prior Publication Data

US 2011/0130313 A1 Jun. 2, 2011

(51) Int. Cl.

| | |
|---|---|
| ***C10M 111/04*** | (2006.01) |
| ***C10L 1/12*** | (2006.01) |
| ***C07F 5/02*** | (2006.01) |
| ***C07F 3/02*** | (2006.01) |

(52) U.S. Cl.
USPC ..... 508/155; 44/314; 977/773; 568/6

(58) Field of Classification Search ..... 508/155; 44/314; 977/773; 568/6
See application file for complete search history.

(56) References Cited

U.S. PATENT DOCUMENTS

| | | | | |
|---|---|---|---|---|
| 3,312,618 | A * | 4/1967 | Le Suer et al. | 508/401 |
| 3,313,727 | A * | 4/1967 | Peeler | 508/156 |
| 4,744,920 | A * | 5/1988 | Fischer et al. | 508/186 |
| 5,380,508 | A * | 1/1995 | Inoue | 423/286 |
| 5,854,182 | A * | 12/1998 | Swami et al. | 508/186 |
| 2010/0113312 | A1 * | 5/2010 | Ward et al. | 508/158 |

* cited by examiner

*Primary Examiner* — Cephia D Toomer
*Assistant Examiner* — Vishal Vasisth
(74) *Attorney, Agent, or Firm* — Robert W Strozier

(57) ABSTRACT

The present invention describes a nanoparticle size composition comprising at least one overbase complex of a magnesium salt and an associated organic boron complex. The present compound is an improvement over previous processes due to less complicated processing requirements and the high concentration of both magnesium and boron that results.

21 Claims, No Drawings

PROCESS FOR PREPARING HIGH CONCENTRATIONS OF MAGNESIUM AND BORON COMBINATION MATERIALS

BACKGROUND OF THE INVENTION

1. Field of the Invention

Embodiments of this invention relate to lubricating compositions including high concentrations of magnesium and boron in the form of nanoparticles and to methods for making and using same.

More particularly, embodiments of this invention relate to lubricating compositions including high concentrations of magnesium and boron in the form of nanoparticles and to methods for making and using same, where the.

2. Description of the Related Art

Overbased magnesium compounds and methods for their production have been known for many years (see for example Hunt; U.S. Pat. No. 3,150,089; Sep. 22, 1964). They have been used in lubricants, as fuel additives in many combustion applications, and in various antifoulant additives used in refineries. These materials have been much sought after for these and many other as yet undiscovered applications.

Similarly, boron containing compositions have been researched from at least the same time period (see for example NACA Research Memorandum RM E55C07; June 1955) for its perceived value as a fuel and fuel additive. The splendid lubricating properties of boron formulations—especially boric acid—have also been widely investigated and are well known to those familiar with the art (see for example the early patent by Chapman; U.S. Pat. No. 905,649).

Attempts to combine the valuable lubricating properties of boron with various magnesium (and/or other alkali or alkaline earth metals) formulations have been ongoing since at least 1967 (see for example U.S. Pat. No. 3,313,727; April 1967; Peeler, R.). Combination products would theoretically combine the benefits imparted by each element. For example there is evidence suggesting that combinations of magnesium with boron would have enhanced properties as improved antifoulants in refinery use and examination of the high temperature region of the phase diagram of both magnesium and boron would suggest the combination of the two could be valuable as high temperature corrosion prevention additives.

Previously, attempts to produce combination compositions were constrained by the relatively low starting magnesium content of products researchers were required to use. This had the dual effect of forcing low magnesium concentrations as well as the amount of boron that could be reacted with the available magnesium compound was then necessarily low. This is a physical reality since the total composition must add up to 100%, the more "space" taken up by the low magnesium content materials; the less "space" is available for the boron containing material. Similar restrictions result from the even lower atomic weight boron. As is well known, boron is a very light element (low atomic weight). Therefore in order to obtain a viable, high boron content, any other element would need to be relatively dilute. This is so because associated molecular constituents of the boron compound would occupy large volumes of the combination product as the boron content is increased. Previous to this invention maximum starting magnesium contents might reach only 9 to 14 percent with concomitantly low resulting boron contents. The compounds of this invention conversely began as 30% magnesium containing liquids—more than double the previous levels—which allowed for a proportional increase in boron concentration.

Previous researchers were also constrained by the fact that most of those other magnesium compounds were comprised of stabilized magnesium carbonate overbases. Thus it was assumed and believed that only magnesium carbonate overbased materials could be boronated. The process of this invention has shown this is not a requirement. In fact it has been discovered there is no difference in reaction of previously carbonated materials and materials that have not been carbonate.

Similarly, nearly all previous patents concerning the combination of magnesium and boron have featured the prominent removal of water either formed during reaction or added as an ingredient at the start of the procedure. This in turn has led to the use of often hazardous, low boiling point liquids required to assist in the removal of the water. The difficult removal of water has in turn required the introduction of many antifoam products to try to assist the often violent distillation of water. The present invention has discovered that the removal of water is not necessary. It has additionally been found the retention of water has an additional benefit of maintaining all boron materials as boric acid. It is boric acid that has been found to have excellent lubricating properties. By the simple and desired retention of water, any boric oxide that forms is retained as boric acid by reconversion back to boric acid with water. Water may additionally be a catalyst to the ultimate reaction. By not needing to use low boiling solvents, there is no possibility they are present in final formulations. This allows for higher flash points which will make transport and use of any resulting materials safer.

By retaining the water in the reaction mass, it has also been found that the reaction can be run very quickly. It is only necessary to heat to about 100° C. which greatly facilitates any manufacturing process contemplated. Since the water is not removed, expensive heat exchangers and cooling facilities may be avoided.

3. Description of Related Art

Examples of the prior art are provided below to demonstrate some of the many methods previously developed. As will be seen nearly all methods require the use of multiple solvents, distillations, and/or multiple steps. They all differ greatly from the present invention due to the increased numbers of raw materials, solvents to be stripped, complex procedures, and in some cases very low alkaline earth and boron metal contents.

In U.S. Pat. No. 3,313,727 Peeler began with a lubricant base oil, a calcium petroleum sulfonate and then added sodium metaborate octahydrate. This mixture was then heated to partially dehydrate. The product was described as a "glass" which would not be equivalent to the flowable liquid product the present invention produces. No description of the metal content of this product was provided, but presumably it was relatively low and the glassy product would have only limited applicability and only for specialized uses.

In U.S. Pat. No. 3,853,772 Adams began with a lubricant oil, an alkali metal borate (previously produced by an undisclosed method and still containing various waters of hydration), added two dispersant materials—one of which contained an alkaline earth metal and sulfur. This was then heated to produce the product. No description of the metal content of this product was provided, but from an approximate mass balance, presumably it was relatively low.

In U.S. Pat. No. 4,683,126 Inoue mixed a neutral calcium sulfonate, a lubricant oil, powdered magnesium hydroxide, boric acid, water, and a cleaning solvent diluent. After processing to remove water and some of the solvent, a product resulted that was 7.7% calcium and 3.8% boron. Other metal contents were not described.

Fisher in U.S. Pat. No. 4,744,920 started with an overbased sodium carbonate sulfonate. To this was added a diluent oil, toluene, boric acid, and an overbased magnesium carbonate sulfonate. After processing to remove water and excess solvent a product containing 7.35% magnesium and 3.94% boron resulted.

In U.S. Pat. No. 4,900,854 Winterton began with rather exotic boron starting materials (bromo metal boranes was one) and worked at dry ice/acetone temperatures to produce a product that met his requirements. The procedure was too involved to be usable for large scale manufacturing procedures.

Erdemir, in U.S. Pat. No. 5,431,830 claimed boron compounds stabilized in solution by various dispersants are useful as lubricant compositions. He further maintained that boric acid possesses the lubricating properties to the extent that he wants to add materials—water—to convert any boric oxide preferentially back to the orthoborate form. He also states that smaller particles of boric acid are more effective as lubricant additives. However, in this patent he does not explain how to achieve these compounds, only that they are useful as lubricants.

In U.S. Pat. No. 5,854,182 Swami worked initially under strictly anhydrous conditions to produce a magnesium alkoxide material to which was subsequently added boric acid and a neutral calcium or magnesium sulfonate material. After heating this mixture, an alcohol byproduct was removed to provide a product (with magnesium sulfonate) containing 4.2% magnesium and 5.1% boron.

In U.S. Pat. No. 6,872,693 Cain describes a material that is produced from a complex mixture of monoalkyl benzene sulfonic acid, xylene, magnesium oxide, acetic acid, polyisobutylene succinic anhydride, methanol, and water. This was then blown with carbon dioxide. Many of these materials, lost during processing, were replaced and the mixture was again blown with carbon dioxide. After stripping solvents and water the final material contained 7.6% magnesium and 4.35% boron.

Robson in U.S. Pat. No. 7,026,273 utilized a lubricant oil already containing a magnesium or calcium material and added boron containing materials to this to produce products of extremely low (less than 0.5%) magnesium (or calcium) and boron (less than 0.2%) content. Presumably these low concentrations were all that was required for his applications.

In patent application 2008/0300426 Duchesne describes a product that begins with a calcium overbased material. To this was added xylene and methanol. This combined mixture was purged with nitrogen to remove all oxygen before adding a boron source. After stripping of solvents a material containing 7.7% calcium and 4.1% boron resulted.

In U.S. Pat. No. 7,479,568 Le Coent produced a material containing 9.4% calcium and 4.1% boron by combining xylene, methanol, calcium hydroxide, a sulfonic acid, boric acid, and a Group I oil. After suitable reaction and stripping of solvents the described material resulted.

In U.S. Pat. No. 7,547,330 Erdemir reveals a boron compound that when added to fuels imparts lubricating properties to engine parts. This composition consisted of a nanometer sized powder of an organic boron compound, e.g., trialkylborates, boroxins, or combinations of these. The thrust of his invention was exclusively to provide a lubricant composition. No mention was made of other applications. Curiously, although the claims of the patent do not encompass the use of boric acid, all of his example formulations illustrate only the use of boric acid. His formulation also relies heavily on mixing his aforementioned boron source material with a suitable lubricating liquid material.

SUMMARY OF THE INVENTION

Many lubricant formulations and boron processes rely on the use of alcohols for added lubrication and water scavenging. Interestingly, we have found that not removing any formed water actually enhances the incorporation of boric acid into the compositions of this invention. Thus, the water theoretically remains in the material or composition to perform this and other functions, for example, insuring any boric oxide formed remains as boric acid when lubricating properties are desired.

Oftentimes borated lubricant compounds possess desired properties of high viscosity indices, good low temperature characteristics, are not corrosive to copper, and possess antiwear properties.

Organometallic boron-containing compounds are another desired class of additives. In low sulfur fuels these organometallic compounds can effect a lowering of the ignition temperature of exhaust particles especially in diesel engines equipped with exhaust system particulate traps. Magnesium is one of the useful metals intended for this purpose.

This invention, in its various aspects, provides a simplified method to produce higher metal content compositions of magnesium and boron. The present invention overcomes certain well-known problems and deficiencies in the prior art, including those outlined above and reiterated below.

Heretofore, many of the proposed methods have been arduous and dangerous to perform. Many have involved highly flammable solvents, inert atmospheres, or the need for extremely long reaction times to achieve "boronation" without excessive foaming. Other methods have employed difficult to work with dispersing aids; some of which require complex reaction schemes to produce in situ the material to be boronated.

By contrast the current invention utilizes a commonly available high magnesium content sulfonate overbase material. The level of boron addition can be easily adjusted to produce any magnesium to boron ratio desired for the needs of the material being produced. Not wishing to be bound by theory, it is believed that either the natural surfactancy of the magnesium sulfonate or carboxylate material is utilized as well as a suspected reaction of boron compounds with the plentiful oxygen of the sulfonic or carboxylate acid chemical group to produce the desired soluble boron compound.

The reaction scheme requires blending completely the various starting materials comprising the previously produced said magnesium sulfonate or carboxylate material, an amount of boric acid to attain the final boron concentration desired, and optionally a minor amount of a low boiling solvent for viscosity control followed by low temperature heating under reflux conditions of the mixture until said boron solid starting material has been completely dissolved into the magnesium compound. Progress of the reaction can be followed by visual inspection of the product to verify all boron materials have been completely dissolved. The resulting material is clear, highly oil soluble, and when desired free of sediment.

We have surprisingly found that when the water formed during boronation is allowed to remain in the materials, there is also less sediment remaining Careful experiments have found that the process of removing water has led to more sediment that subsequently needs to be removed. Conversely, allowing the water to remain in the product has greatly diminished the amount of sediment to levels where removal may no longer be required. It is thus concluded that water actually leads to improved stability of the product and presumably even smaller particles since the boronated material made in this manner has superior clarity.

Products of this invention have also been found to have lower viscosity. This is in contrast to other similar materials that feature increases of viscosity as the incorporated metal contents are increased.

The compositions of the present invention can be any simple boron compound that dissolves in a common solvent to form a solution. Suitable boron compounds include, but are not limited to, boric acid, borax, boron oxide, or combinations of these. With boric oxide in particular, it is very desirable to add additional water to the process to insure boric acid is reformed.

DETAILED DESCRIPTION OF THE INVENTION

Embodiments of this invention provide a simplified process of producing a magnesium/boron combination composition.

Other embodiments of this invention provide a process to produce magnesium/boron compositions including a nanometer sized, free flowing liquid. Nanometer sized materials are produced by methods well known in the art. These magnesium/boron compositions are desired because: (a) they have a very high surface atom to bulk atom ratio, and (b) they can directly be incorporated into fuels and oil products such as base oils and formulated synthetic oils. Most of the atoms in these nanometer sized particles reside on the surface of the particles and are chemically very active. With very high surface energy, they are both physically and chemically attracted to the hydrocarbon molecules in fuels and oils. The high surface energy also causes the boron atoms, in particular, to be attracted to metal surfaces allowing the composition to have improved lubricating properties.

Other embodiments of the present invention provide compositions having high concentrations of boron relative to magnesium. In previous patents, both metals and consequently their ratios remained relatively low.

The process of this invention produces high concentrations of magnesium and relatively high concentrations of the low atomic weight element boron in the same composition. The method of this invention is easier to implement than previous methods. The method of this invention requires only relatively minor manipulations to produce the compositions of this invention. Heretofore, one general problem when working with boron materials has been excessive foaming and the control of same. This problem has been obviated using the low temperature method of the present invention. The need to add hazardous, flammable solvents, alcohols, and water followed by their subsequent arduous stripping have all be eliminated or substantially reduced using the methods of this invention.

The term boronation refers to the process of adding boron in its many forms to an organic material. It should be recognized and understood by those skilled in the art that there are many combinations and possible structures to explain this process. Many of the most likely theories can be found in text books on boron chemistry and will not be reproduced here.

The term overbase relates to that class of compounds that have an excess of base—normally an alkali or alkaline earth element—relative to a stabilizing acid often sulfonic but sometimes carboxylic acid. These products are well known to those skilled in the art. The elements most often useful as overbases are magnesium, calcium, sodium, and zinc.

The term low boiling as used herein means heating below or only slightly above the boiling point of water, i.e., 100° C.

The magnesium source used in this invention is one or more of the standard products available from Liquid Minerals Group, Incorporated (New Waverly, Tex.). The preferred products are LMG-30S® (a 30% magnesium sulfonate) and LMG-30E® (a 30% magnesium carboxylate). These materials are overbases of magnesium reportedly made through a high temperature process with a proprietary blend of sulfonic or carboxylic acids.

Boric acid is widely available. One source that has proven to be reliable is from Rio Tinto, PLC (London, United Kingdom).

Suitable low boiling solvent include, without limitation, any aromatic hydrocarbon with suitable solvency characteristics and minimum flash point to meet transportation needs and requirements of a commercial product.

Envisioned Uses of the Invention

Embodiments of the method of the present invention relate to the production of magnesium and boron compositions having many potential uses. Many of these uses have been known for years and were the impetus for many of the patents previously described. For example, alkaline earth element and boron chemistries have been known for years to provide excellent lubrication properties in lubricating formulations for automobiles and other non-stationary source equipment. Boron and alkaline earth metal formulations have found use as extreme pressure additives.

Combinations of magnesium and boron can be used in refineries as antifoulants. It is believed the boron has interesting properties to coat metal surfaces making them less prone to accumulating deposits. The magnesium continues to provide its neutralization function inhibiting the formation of acidic materials that lead to the materials that actually form deposits. Nano-sized materials are more effective in this application due to their surface activity and greatly increased number of reactive particles.

The magnesium/boron compositions of this invention could be very useful combustion additives. Traditionally, magnesium has been used for this purpose. The addition of boron to an additive could be very useful to inhibit the effects of vanadium especially with respect to high temperature corrosion in gas turbines. There are multiple products of boron and magnesium with vanadium, which could render this widespread contaminant less corrosive in this growing application.

The flexibility of embodiments of the method of this invention in permitting formulations having with relatively high levels of magnesium relative to boron provides many opportunities for additional uses of these compositions in metals. For example, by adjusting the initial charge of boron to magnesium, compounds can be produced for use as an extreme pressure additive, while other compounds can be produced for use as lubricant additives. The method of the invention allows the preparation of magnesium/boron compositions having a wide range of magnesium to boron ratios and having a wide range in magnesium and boron concentrations, such compositions can be tailored to meet the requirements of these varied applications.

These and other benefits of the composition and methods of this invention will be evident to those of ordinary skill in the art.

EXPERIMENTS OF THE INVENTION

The following examples are provided for illustration purposes and should not be construed as limiting the scope of the inventions disclosed herein.

Example 1

A 1000-mL three neck reaction flask was fitted with stirrer, thermometer, and condenser leading to a Dean Stark trap. To the reaction flask were added 466 grams LMG-305®, 240 grams of boric acid, and 93.5 grams of an aromatic solvent, where the solvent improves fluidity of the mixture. The reaction mass was heated to 102° C. and held at that temperature for four hours until the reaction product became visually clear. Minor amounts of solvent and water were removed into the Dean Stark trap during the reaction. The solvent and water were not added back to the mixture. After slight cooling the reaction mass, the reaction mass was filtered through a 20 micron filter. Then the filter was opened flat, only about a 1 cm circle of solids was observed on the filter. The reaction product included 17.5% magnesium and 5.25% boron.

Example 2

To a 500-mL three neck reaction flask fitted with stirrer, thermometer, and condenser leading to a Dean Stark trap was added 201 grams LMG-30S® and 103 grams boric acid. The reaction flask was heated to 104° C. and held at that temperatures for three hours. During this time, the reaction mass clarified. After cooling, the reaction product included 19.8% magnesium and 5.9% boron.

Example 3

To a 4000-mL resin kettle was added 7.0 pounds of LMG-30S® and 2.5 pounds of an aromatic solvent. The resin kettle was assembled and fitted with stirrer, thermometer, and condenser leading to a Dean Stark trap. After heating to about 110° C., about 5 cubic feet of carbon dioxide were passed through the liquid. Solvent removed during this blowing operation was returned to the resin kettle to maintain fluidity. While heating to about 120° C., two pounds of boric acid were added portion wise. Minor foaming was observed with each addition. After all boric acid was added, the reaction mass was allowed to stir at 120° C. During the reaction, the reaction mass was observed to clarify. Filtration of the reaction mass indicated that essentially all of the boron had been incorporated. The reaction product included 18.75% magnesium and 3.3% boron.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

We claim:

1. A composition comprising a dispersion of alkaline earth metal-boron nano-particles in a hydrocarbon solvent, where the nano-particles include from about 1 wt. % to 8 wt. % boron and from about 10 wt. % to about 25 wt. % magnesium and where the dispersion is clear and bright and where the nano-particles are formed at a temperature of about 100° C. without the removal of solvent or water, where the water performs functions in the composition including insuring that boric acid remains or reforms in the composition when lubricating properties are desired.

2. The composition of claim 1, wherein the boron is derived from the group consisting of boron powder, boron alkoxides, boric acid, and/or boranes.

3. The composition of claim 1, wherein the alkaline earth metal is derived from an oil soluble sulfonic or carboxylic acid alkaline earth metal salt.

4. The composition of claim 1, wherein the composition includes substantially no residue.

5. The composition of claim 3, wherein the oil soluble sulfonic or carboxylic acid is an oil soluble hydrocarbon acid having a molecular weight of less than 500.

6. The composition of claim 5, wherein the oil soluble sulfonic acid is a monoalkylbenzene sulfonic acid.

7. The composition of claim 5, wherein the oil soluble sulfonic acid is dodecylbenzene sulfonic acid.

8. The composition of claim 5, wherein the oil soluble sulfonic acid is a mixture of monoalkylbenzene and dialkylbenzene sulfonic acids.

9. The composition of claim 1, wherein a ratio of magnesium to boron is from about 10 to 1 to about 1 to 1.

10. The composition of claim 1, wherein the ratio of magnesium to boron is from about 4 to 1 to about 3 to 1.

11. The composition of claim 1, wherein the boron is derived from boric acid.

12. The composition of claim 1, wherein the hydrocarbon solvent has a boiling point at normal atmospheric pressure of at least about 300° F. and a flash point of at least 100° F.

13. The composition of claim 1, wherein the alkaline earth metal is a magnesium sulfonic acid salt.

14. The composition of claim 1, wherein the alkaline earth metal is a mixture of a magnesium monoalkylbenzene sulfonic acid salt and a magnesium dialkylbenzene sulfonic acid salt.

15. The composition of claim 3, wherein the oil soluble caboxylic acid is a mixture of linear and cyclic carboxylic acids.

16. The composition of claim 3, wherein the oil soluble carboxylic acid is a mixture of fatty acids.

17. The composition of claim 1, wherein the alkaline earth metal is a magnesium carboxylic acid salt.

18. The composition of claim 1, wherein the alkaline earth metal is a is a mixture of magnesium fatty acid salts.

19. A method for prepare a dispersion of nano-particles comprising:

contacting a boron donor and an oil soluble alkaline earth metal sulfonic acid salt and/or carboxylic acid salt in the presence of a hydrocarbon solvent for a time and at a temperature to produce a clear, bright dispersion of alkaline earth metal-boron nano-particles in a hydrocarbon solvent, where the nano-particles include from about 1 wt. % to 8 wt. % boron and from about 10 wt. % to about 25 wt. % magnesium without the removal of solvent or water, where the water performs functions in the composition including insuring that boric acid remains or reforms in the composition when lubricating properties are desired.

20. A fuel composition comprising a fuel and an effective amount of a clear, bright dispersion of alkaline earth metal-boron nano-particles in a hydrocarbon solvent, where the nano-particles include from about 1 wt. % to 8 wt. % boron and from about 10 wt. % to about 25 wt. % magnesium and where the nano-particles are formed at a temperature of about 100° C. without the removal of solvent or water, where the water performs functions in the composition including insuring that boric acid remains or reforms in the composition when lubricating properties are desired, and where the effective amount is sufficient to improve fuel efficiency and lubricity.

21. A lubricating composition comprising a lubricant and an effective amount of a clear, bright dispersion of alkaline earth metal-boron nano-particles in a hydrocarbon solvent, where the nano-particles include from about 1 wt. % to 8 wt. % boron and from about 10 wt. % to about 25 wt. % magnesium and where the nano-particles are formed at a temperature of about 100° C. without the removal of solvent or water, where the water performs functions in the composition including insuring that boric acid remains or reforms in the composition when lubricating properties are desired, and where the amount is sufficient to improve lubricity.

* * * * *